United States Patent [19]

Kaletsky

[11] Patent Number: 4,573,490

[45] Date of Patent: Mar. 4, 1986

[54] APPARATUS FOR THE AUTOMATIC PURGING OF THE RESERVOIR IN A WATER RECIRCULATION SYSTEM

[76] Inventor: Robert B. Kaletsky, 2009 N. 46th St., Phoenix, Ariz. 85008

[21] Appl. No.: 591,042

[22] Filed: Mar. 19, 1984

[51] Int. Cl.[4] ..... F04F 10/00

[52] U.S. Cl. ..... 137/124; 134/166 R; 137/132; 137/571; 261/36 R; 261/DIG. 3; 261/DIG. 46

[58] Field of Search ..... 261/29, 36 R, DIG. 3, 261/DIG. 46, DIG. 41; 210/97, 99; 134/184, 186, 201, 166 R; 137/132, 143, 124, 571; 62/310

[56] References Cited

U.S. PATENT DOCUMENTS

| | | | |
|---|---|---|---|
| 287,179 | 10/1883 | Sexton | 137/132 X |
| 545,566 | 9/1895 | Wrigley | 137/143 X |
| 1,226,758 | 5/1917 | Dufty | 137/124 |
| 2,621,666 | 12/1952 | Ornas | 134/186 X |
| 2,646,061 | 7/1953 | Bottum | 261/DIG. 46 |
| 3,228,665 | 1/1966 | Dolan | 261/DIG. 46 |
| 3,265,371 | 8/1966 | McGrath | 137/143 X |
| 3,640,265 | 2/1972 | Swart, Sr. | 261/DIG. 46 |
| 3,643,930 | 2/1972 | Schulze, Sr. | 261/DIg. 46 |
| 3,716,043 | 2/1973 | Chilcoat | 261/DIG. 41 |
| 3,971,549 | 7/1976 | Habig | 137/571 X |
| 4,192,832 | 3/1980 | Goettl | 261/36 R |
| 4,289,713 | 9/1981 | Goettl | 261/27 |
| 4,290,444 | 9/1981 | Bevan | 137/571 X |
| 4,361,522 | 11/1982 | Goettl | 261/66 |
| 4,369,148 | 1/1983 | Hawkins | 261/36 R |
| 4,389,352 | 6/1983 | Bohanon, Sr. | 261/DIG. 41 |

*Primary Examiner*—Richard L. Chiesa
*Attorney, Agent, or Firm*—Joseph H. Roediger

[57] ABSTRACT

Apparatus for automatically purging the primary reservoir in an evaporative cooler which utilizes a secondary reservoir supplied with a portion of the output flow of the recirculating pump. The primary and secondary reservoirs each contain drain valves actuated when the fluid level therein exceeds a predetermined level. The normal operating fluid level in the primary reservoir is established below the drain level. When the secondary reservoir is filled and drains, its flow is directed into the primary reservoir causing it to exceed its fluid drain level and thus automatically purge the primary reservoir of fluid.

7 Claims, 4 Drawing Figures

APPARATUS FOR THE AUTOMATIC PURGING OF THE RESERVOIR IN A WATER RECIRCULATION SYSTEM

BACKGROUND OF THE INVENTION

This invention relates to apparatus for automatically purging the reservoir of a water recirculating system and, in particular, for draining and refilling the reservoir of an evaporative cooler.

Fluid systems wherein a working fluid, typically water, is continually recirculated during operation to a utilization means are typically exposed to and interact with the environment. This is particularly the case when the evaporative properties of the fluid are utilized to produce a cooling effect on a portion of the fluid itself or a second fluid in heat exchanging relation thereto. For example, the evaporative cooler commonplace in arid climates for cooling an air stream relies on a low humidity environment for successful operation. The cooler utilizes water saturated pads with air being drawn therethrough with the evaporation of a portion of the water cooling the circulated air.

In operation, the water is continually recirculated from a primary reservoir to a position above the pads from which it travels downward by gravitational effect to return to the reservoir. Since evaporation reduces the amount of water returned to the reservoir, make-up water is continually added to the reservoir to maintain it at a desired level. The contaminents in the water are for the most part not volatile so that the concentration of contaminants in the reservoir builds during continued operation leading to rusting, scaling and mineral deposition. These undesired effects shorten the maintenance cycle of the system and also reduce its operating life time.

The deleterious effects of mineral build-up can be significantly reduced by frequent and regular purging of the reservoir coupled with refilling it from the supply course which tends to reduce the impurity and mineral content departures from the baseline or supply source levels. In industrial fluid recirculating systems wherein selective loss of the working fluid takes place over a period of time, a series of valves and timers are normally provided to accomplish regular and automatic purging of the system reservoir. The larger scale units can include this additional equipment without significant incremental cost increases. However, the small application unit, typically the evaporative cooler used on single-family residences, is a relatively inexpensive unit and the addition of electrically operated valves and timers significantly add to the cost. Further, a cost-benefit analysis on the incorporation of such additional parts in evaporative coolers frequently leads to the conclusion that the addition of times or remote-actuated purge apparatus is not economically sound from a marketing standpoint.

At present, the typical user of an evaporative cooler relies on his own scheduled maintenance program to purge the reservoir of his water recirculation system. Since the apparatus is normally placed near the highest portion of the house, the periodic draining per schedule is frequently ignored with the dual consequences that the bottom rusts through within a few years while the mineral deposits adversely affect the pump and water intake valve. As an alternative, impurity gathering elements such as magnesium-containing blocks are often placed in the water to attract mineral impurities. These elements cause a precipitation of impurities thereby reducing the frequency between required draining operations. While evaporative coolers incorporating remotely-actuated valves for purging the reservoir are known, the valves have been found to become inoperable due to scale formation from mineral deposition over a period of time. Thus, the devices are unreliable and the owner of the evaporative cooler is unsure of the frequency of the purges since he frequently is not aware of the failure of the automated apparatus to function properly on a regular basis.

Several designs of automatic purge and refill apparatus for affixation to the base of existing coolers have been proposed. These units rely on the cessation of the operation of the pump coupled with the drain back of water within the circulation network to cause the water level to rise to the point where a siphon drain valve is primed to cause the reservoir to be evacuated. While the purging of the reservoir is accomplished, the evaporative cooler is rendered inoperative during the drain and refill cycle thereby requiring the user to forego the cooling effects of the apparatus for that period. This approach to automatic purging which renders the entire apparatus inoperable on a regular basis has not been favored by the user.

Accordingly, the present invention provides a means for automatic purging of the reservoir of a fluid circulating system which is operative without significantly disabling the operation of the circulation pump which continues to provide fluid to the utilization means during a major portion of the purging interval. Further, the invention is capable of being retrofitted into existing installations without altering the mounting of the structure.

SUMMARY OF THE INVENTION

This invention is directed to automatic purge apparatus for use in a fluid recirculation system wherein fluid is pumped from a primary reservoir through a circuit containing utilization means and from said means to reenter the primary reservoir.

The primary reservoir contains input and output ports through which the body of the working fluid is added to or purged from. A fluid regulating means is located at the input port for controlling the entry of fluid into the primary reservoir from an external source. A pump means positioned so as to be in fluid communication with the primary reservoir provides the lifting force to initiate the circulation of fluid through the system to the utilization means. Primary relief means are located at the output port of the primary reservoir for purging the primary reservoir when the fluid therein reaches a first level. Since a portion of the working fluid is lost during the circulation through the system, i.e., the return typically taking place by a gravity feed into a large area primary reservoir, the fluid regulating means is provided to maintain the fluid level in the primary reservoir at a minimum level.

A secondary reservoir is positioned to receive a portion of the fluid being circulated through the system. This is accomplished by the use of diversion means in fluid communication with the output flow from said pump means for diverting a predetermined portion of the fluid therefrom into said secondary reservoir. Secondary relief means is mounted in the secondary reservoir for removing at least a portion of the fluid therefrom when the fluid level in the secondary reservoir reaches a predetermined level and directing said removed portion into the primary reservoir.

In operation, the regulating means establishes a minimum fluid level for the primary reservoir which is less than said first level. When the secondary reservoir is filled by the diversion means to the predetermined level, fluid therefrom is directed into the primary reservoir thereby increasing its level to at least the first level thereby initiating the purging action which drains the primary reservoir. A delay means is provided which is operatively connected to the fluid regulating means to delay the entry of fluid into the primary reservoir so that the purging of the reservoir is accelerated.

Further features and advantages of the invention will become more readily apparent from the following detailed description of a specific embodiment of the invention when taken in conjunction with the accompanying drawings.

DESCRIPTION OF THE PREFERRED EMBODIMENT

Figure 1:
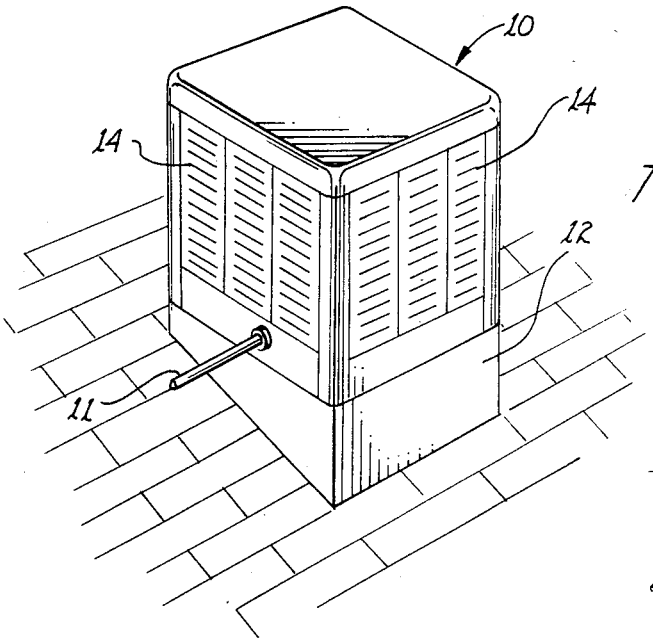
FIG. 1 is a perspective view of an evaporative cooler using a water recirculation system mounted for operation.

Referring now to FIG. 1, a fluid recirculating system contained in a typical case 10 for an evaporative cooling system is shown in its operative position mounted on a roof top. An external water connection 11 is provided for the initial filling of the primary reservoir and to supply make-up fluid to compensate for losses due to the exposure of the fluid to the environment in the utilization means contained therein. The case 10 is provided with removable side panels 14 which permit periodic replacement of the cooler pads therein and is shown mounted on an angled base member to compensate for the pitch of the roof thereby keeping the unit in a fixed substantially level position.

Figure 2:
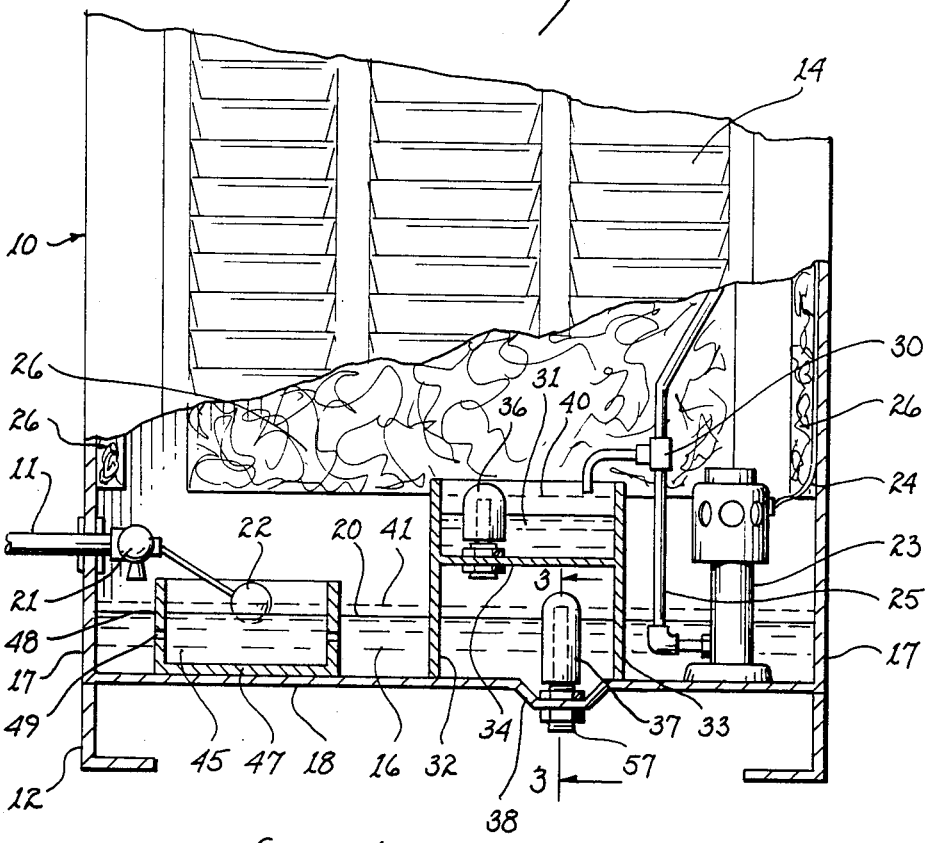
FIG. 2 is a front view in partial section of the evaporative cooler of FIG. 1 with one embodiment of the invention contained therein.

In FIG. 2, a portion of the removable front panel 14 is cut-away to show a partial section of an embodiment of the invention which is designed for installation in an existing evaporative cooler. The cooler includes a primary reservoir 16 defined by side walls 17 and base 18. Fluid is shown therein at level 20 which is the minimum operating level for the recirculation system under formal conditions. The external water supply is connected through the sidewall via connector 11 to a float controlled valve 21. The intake flow of fluid into the evaporative cooler is determined in the conventional manner by the vertical attitude of ball 22 which floats upon and is therefore responsive to the adjacent fluid level to thereby maintain said minimum operating level.

An air-cooled pump 23 electrically connected to an external power source via leads 24 is positioned in the primary reservoir 16 and delivers the fluid therein via conduit 25 upwardly to the utilization means which typically includes a distribution system located at the top of the case for directing the fluid stream into the top of side-mounted vertical pads 26. The fluid travels downwardly through the pads under gravitational force and returns to the primary reservoir 16. Since the evaporative cooler draws air through the louvers in the side panels 14 and the adjacent pads, the evaporation of a portion of the returning fluid cools the air which results in a net loss to the quantity of fluid returning to the primary reservoir.

The float controlled valve 21 operates to maintain the minimum fluid level and supply make-up fluid to the primary reservoir. A further loss to the fluid being circulated through the system is intentionally caused by the use of a diversion means 30 located in the conduit 25 from the pump. The diversion means, preferably a tee-connector with the stem of the tee having a small orifice therethrough, directs a predetermined portion of the pump output into a secondary reservoir 31 bounded by base member 34 and side legs 32 and 33. The side legs both define the reservoir and support it above the primary reservoir. A syphon relief valve 36 is mounted about a hole in the base of the secondary reservoir and when the fluid level therein reaches level 40, the contents of the secondary reservoir are directed into the primary reservoir 16. The time required to fill the secondary reservoir to the level at which it automatically empties its contents into the primary reservoir is determined by the amount of the pump output which is diverted through the small orifice of the tee and the position of the fluid level 40 which is controlled by the height at which the relief valve 36 becomes operational. The time required to fill the secondary reservoir 31, and thus the cycle time of the automatic purge, when the invention is installed is primarily dependent upon the output volume of the pump since the tee-connector diverts a percentage of this flow into the secondary reservoir.

Figure 3:
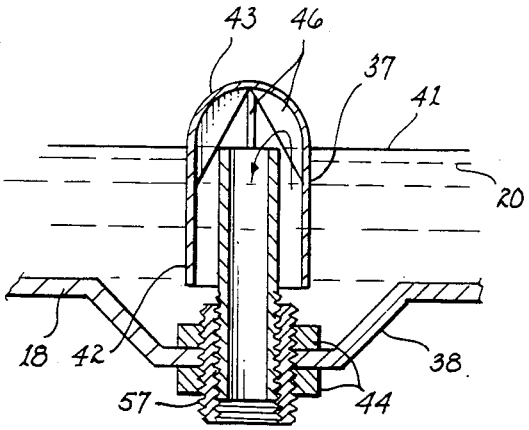
FIG. 3 is a side view in section of the primary relief means employed in the embodiment shown in FIG. 2.

A similar syphon relief valve 37 is located about a hole provided in the depression 38 of the base 18 of the primary reservoir. When the fluid level in the primary reservoir 16 exceeds level 41, the syphon valve is operational to purge the primary reservoir of substantially all fluid contained therein. The relief valve 37 is shown in further detail in FIG. 3 and includes a hollow pipe 42 threaded on its lower end into double threaded sleeve 57. The sleeve 57 is inserted into the hole provided in depression 38 of base 18. Threaded fasteners 44 are used to affix it to the base. A cap member 43 containing inner spacers 46 is placed upon the upper end of pipe 42 and spaced therefrom to permit the passage of fluid into the pipe. The sides of cap member extend downwardly, to the level at which the syphoning action is intended to cease. This cessation occurs due to the entering of air under the cap member. Since an objective of the invention is to purge the primary reservoir, the sides of cap member 43 preferably extend down into depression 38 below the level of the reservoir base 18. The syphon relief valve 36 is similar to relief valve 37. In operation, when the fluid level of the reservoir rises to the top of the vertical pipe, a syphon begins and continues until the fluid level on the reservoir drops below the lower edge of the cap member.

When the fluid level in the secondary reservoir reaches the level 40 as shown, its contents are added to the primary reservoir thereby raising the fluid level therein from level 20 to at least level 41 thereby initiating an automatic purge of the primary reservoir through primary relief valve 37. Since the valve 21 is responsive to a fluid level lower than level 20 and is actuated to provide intake fluid to the primary reservoir in that event, the primary reservoir is being purged rapidly through relief valve 37 while fluid is being added from valve 21. This dual effect ceases when the vacuum is broken and syphon action terminated at the primary relief valve.

During the period of time that primary relief valve is operating with the fluid level below level 20, water is being added to the reservoir. Substantially all of the additional water is lost through the action of valve 37. To reduce this water loss, a delay means for valve 21 is provided by the addition of a tertiary reservoir 45 containing bottom member 47 and sidewalls 48 having openings 49 therein. The openings 49 are spaced above the bottom member 47 to prevent the water level in the tertiary reservoir from dropping below the level defined by openings 49.

The tertiary reservoir is located in the primary reservoir so as to receive the float 22 of valve 21. The fluid communication between reservoirs provided by openings 49 results in the establishment of level 20 in both reservoirs as the actuation level for the valve 21. As fluid loss in the primary reservoir takes place during normal operation, the loss is gradual and the level in the tertiary reservoir responds accordingly until the valve 21 is actuated to provide the make-up fluid necessary to restore the fluid level in each to level 20. Since these changes are gradual, the operating fluid levels between reservoirs differs only by a relatively small amount. However when the contents of the secondary reservoir are added to the primary reservoir and purging through valve 37 occurs, the fluid level in the primary reservoir drops rapidly. The fluid level in the tertiary reservoir changes at a rate based on the size of the openings 49 in the sidewalls. These openings are limited in size so that the tertiary reservoir drains less rapidly than the rate at which the primary reservoir is purged through valve 37. In addition, the tertiary reservoir does not drain below the level established by the openings 49. Thus, the intake valve 21 is not turned on to its maximum input volume while the primary reservoir is draining and is operated at a reduced input flow level. As a result, the purging operation consumes a reduced quantity of fluid before the vacuum is broken and valve 37 is no longer operational.

The embodiment shown in FIG. 2 is adapted for installation in an evaporative cooler system that is presently in place and requires merely the addition of a primary relief valve in the base of the cooler reservoir, the installation of the diversion tee in the pump output line and the placement of the secondary reservoir with its relief valve on the base of the primary reservoir. The adjustment of the height of the threaded inner pipe 37 can be varied based on the impact of fluid level that the addition of the contents of the secondary reservoir has on the level of the primary reservoir. This varies based on the size and type of evaporative cooler in which the embodiment is to be installed. The tertiary reservoir is placed on the base of the primary reservoir and its response may be altered by inserting an elevating member underneath it or altering the size and number of holes therein.

Figure 4:
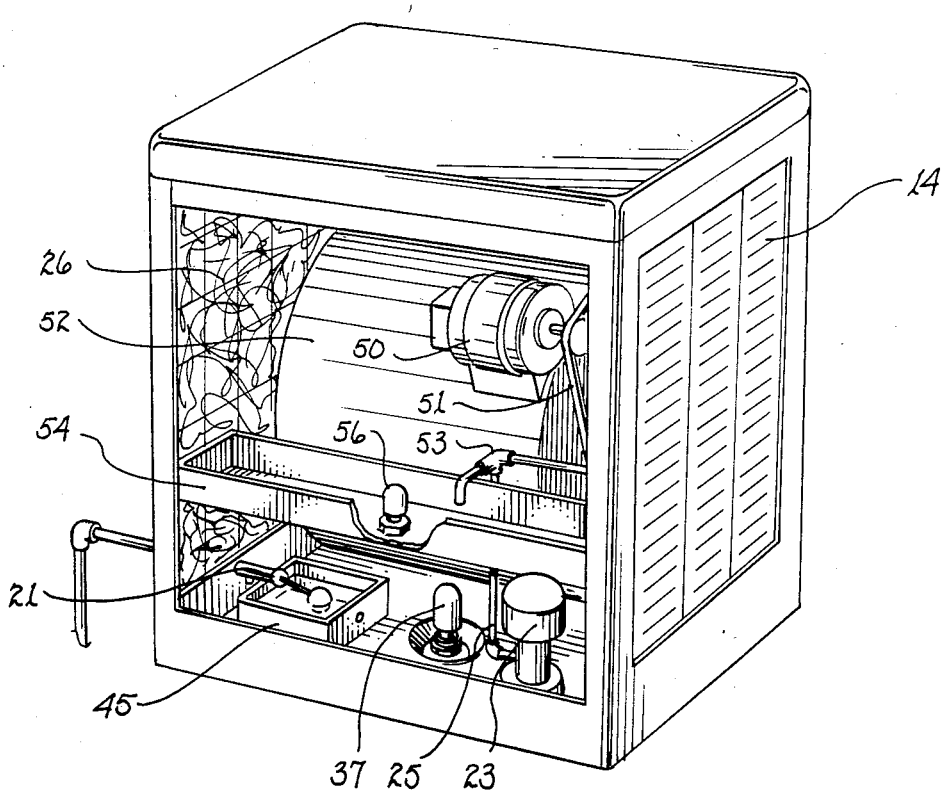
FIG. 4 is a front view in perspective with the front panel removed showing a second embodiment of the invention.

The embodiment of FIG. 4 shows an evaporative cooler assembly with one panel removed which incorporates a secondary reservoir 54 across one side of the interior frame above the primary reservoir. The pump 23 is located on the base of the primary reservoir and the output conduit 25 extends upwardly therefrom. A diversion tee 53 of different configuration than in the embodiment of FIG. 2 is used to provide the input for the secondary reservoir. A secondary relief valve 56 is provided and the flow therefrom is directed into the primary reservoir. The tertiary reservoir 45 is placed under the ball attached to the intake valve 21. While primary relief valve 37 is shown centrally located, it is often offset to enable it to be connected to an external flow path should one be desired.

In operation, the primary reservoir is filled, pump 23 is operating to deliver the fluid to the tops of pads 26 and motor 50 drives the fan 52 by means of belt 51. A portion of the pump output is diverted into the secondary reservoir 54 and it fills until the relief valve 56 operates. The intake valve 21 has maintained the fluid levels in the tertiary reservoir 45 and the primary reservoir so that the addition of the contents of the secondary reservoir results in relief valve 37 purging the primary reservoir. The refilling of the primary reservoir is delayed by the action of the tertiary reservoir in more slowly lowering the level of the ball of valve 21 and then maintaining it at its minimum level.

While the foregoing description has referred to specific embodiments of the invention it is to be recognized that variations and modifications may be made therein without departing from the scope of the invention as claimed.

What is claimed is:

1. Automatic purge apparatus for a fluid recirculation system containing fluid utilization means which comprises:

(a) a primary reservoir having input and output ports;

(b) fluid regulating means for controlling entry of fluid through said input port;

(c) pump means located in fluid communication with the primary reservoir, the actuation of the pump means initiating the circulation of fluid through the system;

(d) a secondary reservoir for receiving a portion of the fluid circulating through said system;

(e) diversion means in fluid communication with said pump means for diverting a portion of the fluid therefrom to the secondary reservoir;

(f) primary relief means located at the output port of the primary reservoir, said primary relief means purging the primary reservoir when the fluid therein reaches a first level; and (g) secondary relief means mounted in the secondary reservoir for removing fluid therefrom when said fluid reaches a predetermined level, said relief means directing at least a portion of the contents of the secondary reservoir into said primary reservoir.

2. The apparatus of claim 1 wherein said fluid regulating means is operable to permit fluid entry into said primary reservoir only when the fluid therein is below a minimum level.

3. The apparatus of claim 2 wherein said first level at which said primary relief means is operable to purge the primary reservoir is higher than said minimum level.

4. The apparatus of claim 3 wherein the volume of water purged by the secondary relief means from said secondary reservoir is at least as large as the volume of fluid required to raise the fluid level in said primary reservoir from the minimum level to the first level.

5. The apparatus of claim 4 further comprising delay means operatively coupled to said fluid regulating means for delaying the entry of fluid through said input port for an interval after the fluid level in the primary reservoir is below said minimum level.

6. The apparatus of claim 5 wherein said delay means comprises a tertiary reservoir in restricted fluid communication with the primary reservoir, said fluid regulating means being operable to permit fluid entry into said primary reservoir when the fluid level in said tertiary reservoir is below the minimum level.

7. The apparatus of claim 6 wherein said tertiary reservoir is located within the primary reservoir.

* * * * *